US007385564B2

(12) United States Patent
Zihlman

(10) Patent No.: US 7,385,564 B2
(45) Date of Patent: Jun. 10, 2008

(54) SATELLITE DISH ANTENNA MOUNTING SYSTEM

(75) Inventor: Brian Steven Zihlman, Mt. Pleasant, IA (US)

(73) Assignee: Winegard Company, Burlington, IA (US)

( * ) Notice: Subject to any disclaimer, the term of this patent is extended or adjusted under 35 U.S.C. 154(b) by 246 days.

(21) Appl. No.: 11/401,757

(22) Filed: Apr. 10, 2006

(65) Prior Publication Data

US 2007/0210978 A1 Sep. 13, 2007

Related U.S. Application Data

(60) Provisional application No. 60/781,427, filed on Mar. 10, 2006.

(51) Int. Cl.
*H01Q 1/12* (2006.01)

(52) U.S. Cl. ..... 343/878; 343/892

(58) Field of Classification Search ..... 34/878, 34/892, 880, 881, 882, 840
See application file for complete search history.

(56) References Cited

U.S. PATENT DOCUMENTS

| | | | | |
|---|---|---|---|---|
| 5,210,544 | A * | 5/1993 | Jones et al. | 343/840 |
| 5,707,033 | A | 1/1998 | Holt et al. | |
| 6,232,928 | B1 | 5/2001 | Zimmerman et al. | |
| 6,404,400 | B1 | 6/2002 | Tulloch | |
| 6,445,361 | B2 * | 9/2002 | Liu et al. | 343/882 |
| 6,460,821 | B1 * | 10/2002 | Rhudy et al. | 248/534 |
| 6,466,181 | B1 | 10/2002 | Ho et al. | |
| 6,682,029 | B1 | 1/2004 | Dierkes | |
| 2002/0005816 | A1 | 1/2002 | Ginther et al. | |
| 2004/0119655 | A1 * | 6/2004 | Hunt | 343/878 |
| 2005/0001781 | A1 * | 1/2005 | Antoine | 343/878 |
| 2005/0057428 | A1 * | 3/2005 | Fujita | 343/882 |
| 2005/0264467 | A1 | 12/2005 | Lin et al. | |

OTHER PUBLICATIONS

DISH 500 Installation Instructions with Angles Table, 2000, pp. 1-28, EchoStar Technologies Corporation, Englewood, Colorado U.S.A.

Special Instructions for the DishPro Mover's Kit, pp. 1-8, EchoStar Technologies Corporation, Englewood, Colorado U.S.A. 1995.

WINEGARD 46 cm & 60 cm Offset Antenna Assembly Instructions, 1998, Winegard Company, Burlington, Iowa U.S.A.

* cited by examiner

*Primary Examiner*—Huedung Mancuso
(74) *Attorney, Agent, or Firm*—W. Scott Carson

(57) ABSTRACT

A satellite antenna mounting system primarily for residential homes including a dish, feed horn, elevation, clamp, and mast. The main body of the clamp to which the assemblage of the dish, feed horn, and elevation bracket are attached is provided with a downwardly inclined tab or clip member. In operation, the clamp of the assemblage can be lowered to receive the upper portion of the mast which is affixed to the roof or other part of the house. In doing so, the clip member engages the upper rim of the mast and firmly attaches or clips the assemblage to the mast with the dish in its desired elevation. Thereafter, the loose clamp can be tightened about the upper portion of the mast at the desired azimuth without affecting the set elevation of the dish.

23 Claims, 16 Drawing Sheets

Fig. 20
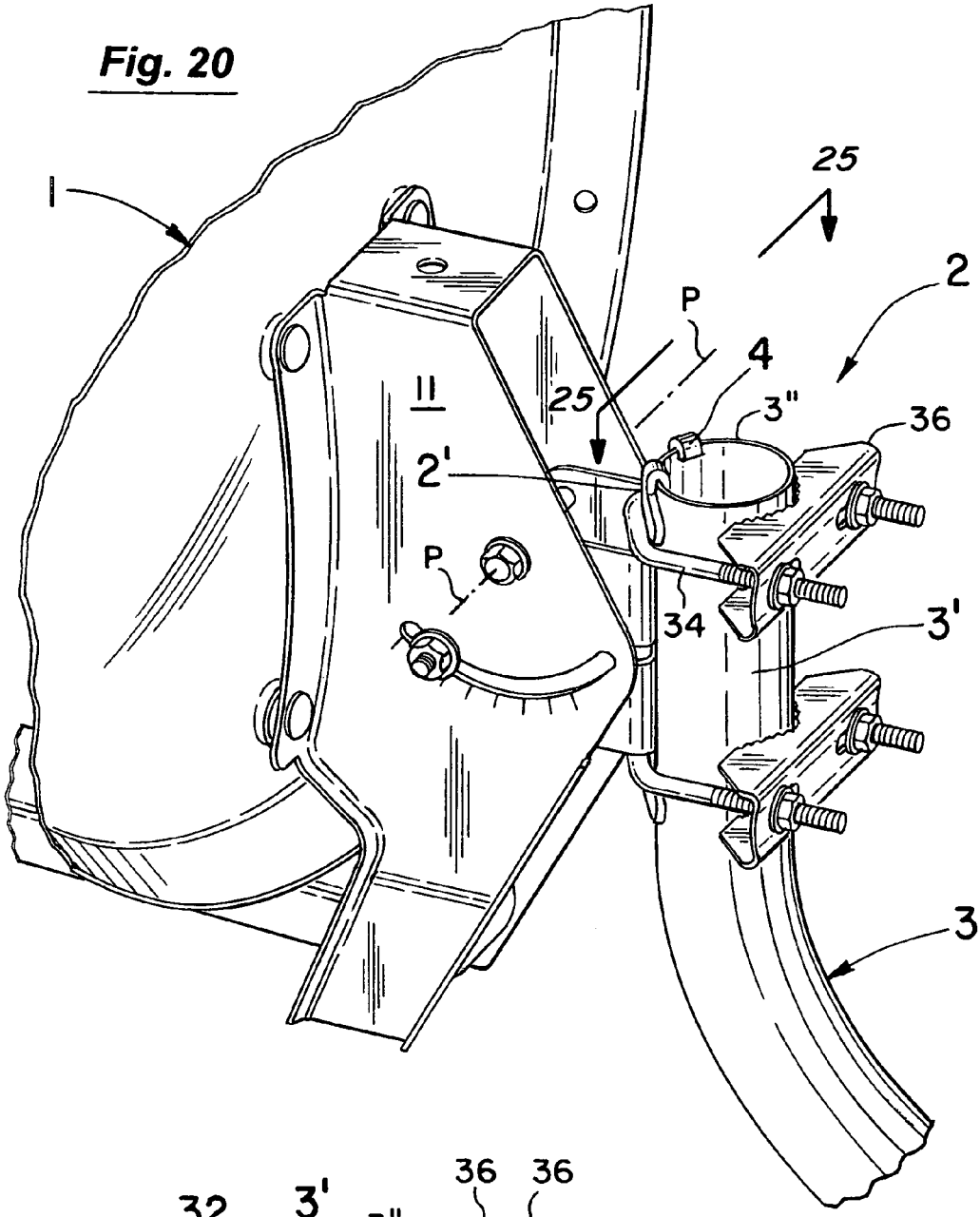
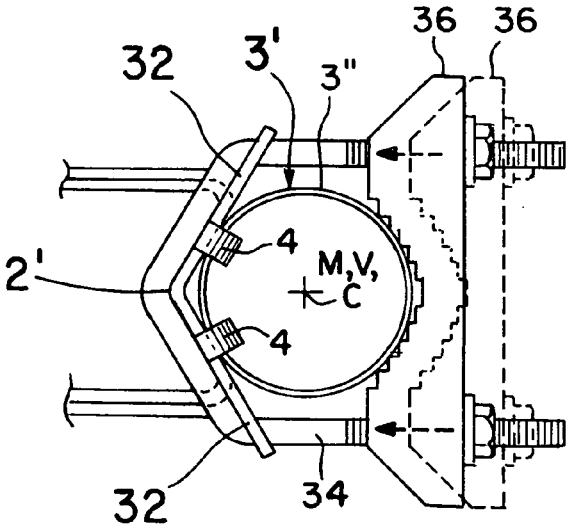
Fig. 25

SATELLITE DISH ANTENNA MOUNTING SYSTEM

RELATED APPLICATIONS

This application claims the benefit of U.S. Provisional Patent Application Ser. No. 60/781,427 filed Mar. 10, 2006, which is incorporated herein by reference.

BACKGROUND OF THE INVENTION

1. Field of the Invention

This invention relates to the field of antenna mounts and more particularly to the field of satellite dish antenna mounts primarily for residential use.

2. Discussion of the Background

Residential dish antennas for satellite reception are commonly mounted by one person on a customer's house (e.g., roof or wall). In installing the antenna, the dish is first typically secured to an elevation bracket which in turn is adjustably attached to a mast clamp. Such mast clamps commonly have a C-shape and can be secured about a vertically extending portion of a mast that is fixed to the roof or other part of the house. In doing so, the upper portion of the mast is initially received in the loose clamp. The clamp is then further lowered onto the mast until a pivot bolt of the elevation bracket that extends across the C-shape of the clamp contacts the upper portion of the mast. With the pivot bolt abutting the upper mast portion and the clamp still loose, the installer can then manually rotate the dish and attached elevation bracket and clamp about the vertical axis of the mast to a desired azimuth and tighten the clamp on the mast.

A problem in this basic installation procedure is that the weight of the assemblage of the dish, attached feed horn, elevation bracket, and clamp is virtually all on one side of the axis of the clamp. Consequently, it is extremely difficult for one installer to simultaneously manually support the assemblage, guide its clamp onto the mast, rotate the assemblage about the vertical axis of the mast, and tighten the clamp on the mast. This is particularly difficult if it is windy and/or the antenna is being mounted in tight or awkward quarters. Complicating the matter, the bolt of the elevation bracket abutting the top of the mast also acts as a pivot for the off-center assemblage when the clamp is loose. As a result, the axis of the clamp is tilted and not vertically aligned when the clamp is loose. Tightening the clamp on the mast will then straighten the clamp and its axis. However, in doing so, the elevation of the dish attached to the clamp is also changed as the clamp is tightened to bring its axis into alignment with the vertical axis of the mast.

As a practical matter, the installer must make his best initial estimate of the correct elevation setting and then wait for the completion of the tightening step of the clamp to see if the final position of the clamp and attached dish resulted in the correct elevation. If not, the elevation bracket and attached dish must be re-adjusted on the clamp. To the extent any re-adjustment of the elevation adversely affects the desired azimuth setting, the entire procedure may have to repeated once or even several times. The fundamental problem with such current antenna mounts of this kind is that the tightening step of the clamp to lock in the azimuth is not independent of and in fact affects the elevation alignment of the dish.

With this and other problems in mind, the present invention was developed. In it, the assemblage of the clamp and attached dish, feed horn, and elevation bracket can be placed on the mast in the desired set elevation even with the clamp loose. With the assemblage then at or moved to the desired azimuth on the mast, the clamp can be tightened without changing or otherwise affecting the set elevation.

SUMMARY OF THE INVENTION

This invention involves a satellite antenna mounting system primarily for residential homes. In it, a downwardly inclined tab or clip member is provided on the main body of the clamp to which the assemblage of the dish, feed horn, and elevation bracket are attached. In operation, the clamp of the assemblage can be lowered to receive the upper portion of the mast which is affixed to the roof or other part of the house. In doing so, the clip member engages the upper rim of the mast and firmly attaches or clips the assemblage to the mast with the dish in its desired elevation. Thereafter, the loose clamp can be tightened about the upper portion of the mast at the desired azimuth without affecting the set elevation of the dish.

In this manner, the independent operation of the elevation and azimuth settings allows for quick and efficient alignment of the satellite antenna system on the house. In effect and unlike current systems, the dish elevation can be correctly set prior to locking or clamping the dish on the mast in the desired azimuth position.

BRIEF DESCRIPTION OF THE DRAWINGS

FIGS. 20-25 illustrate an embodiment in which the substantially C-shaped main body of the mast clamp has relatively flat sides forming the C-shape with a clip member on each side.

DETAILED DESCRIPTION OF THE INVENTION

Figure 1:
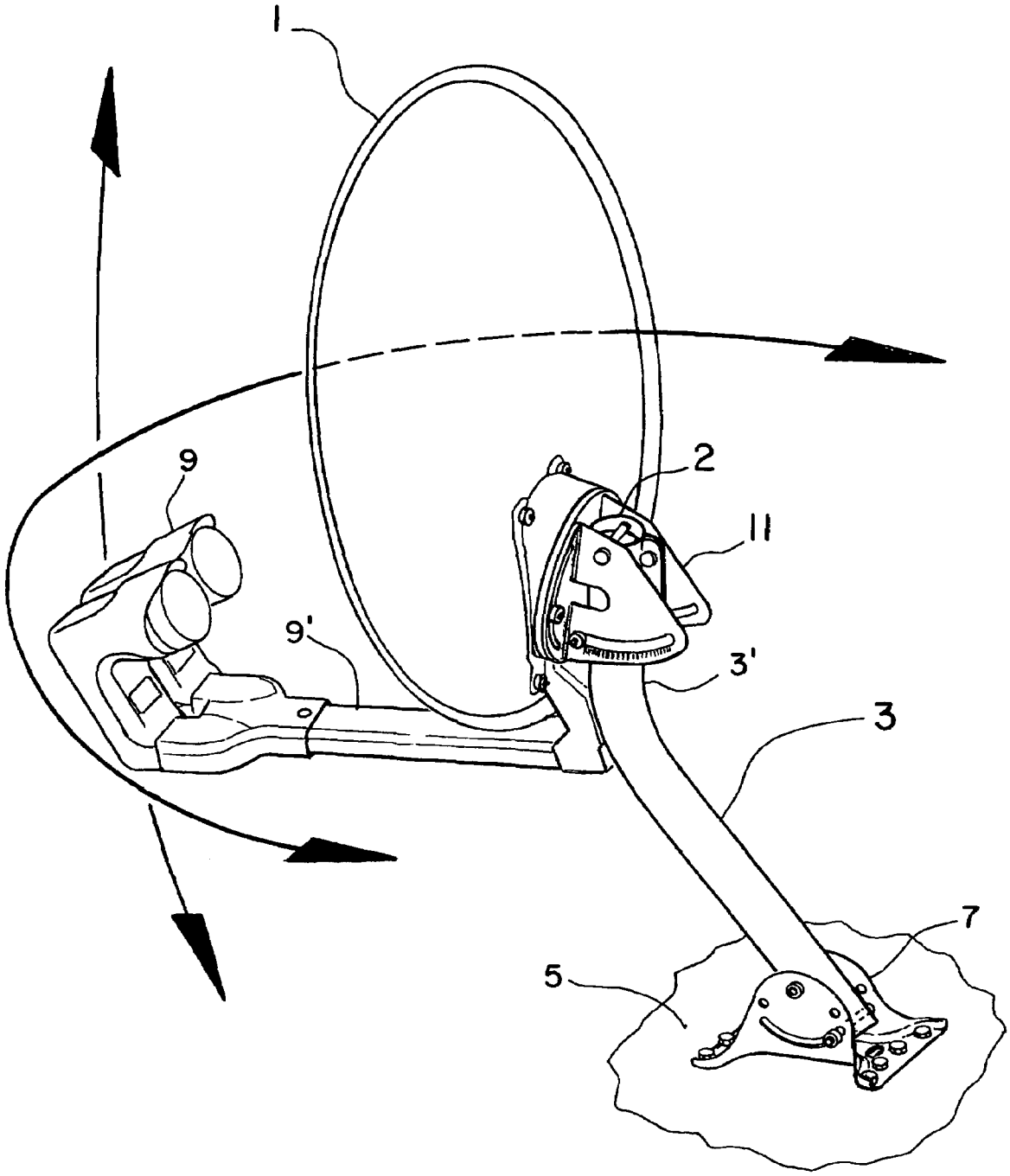
FIG. 1 is a perspective view of the satellite dish antenna mounting system of the present invention.
Figure 2:
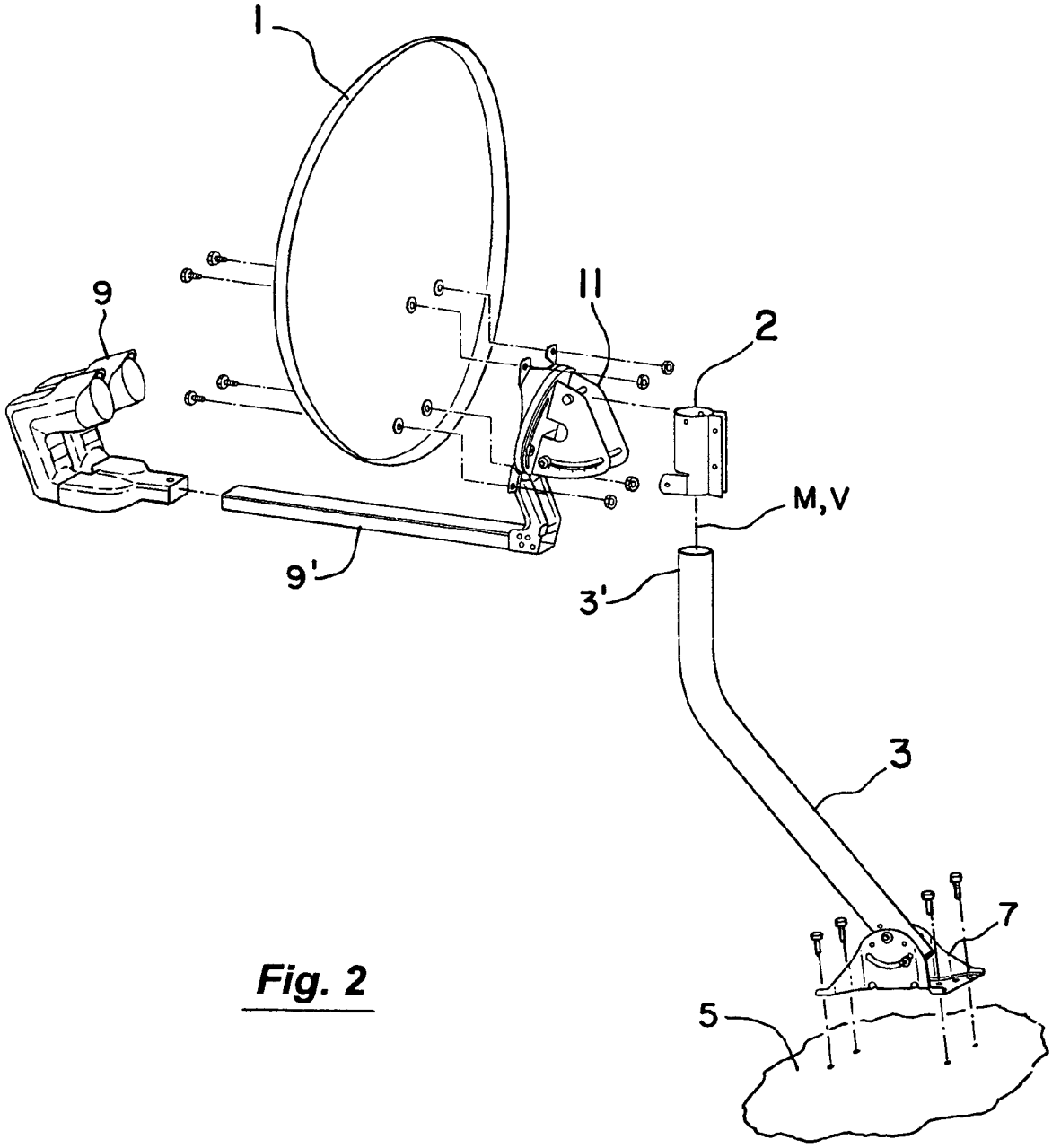
FIG. 2 is an exploded view of the mounting system of FIG. 1.
Figure 5:
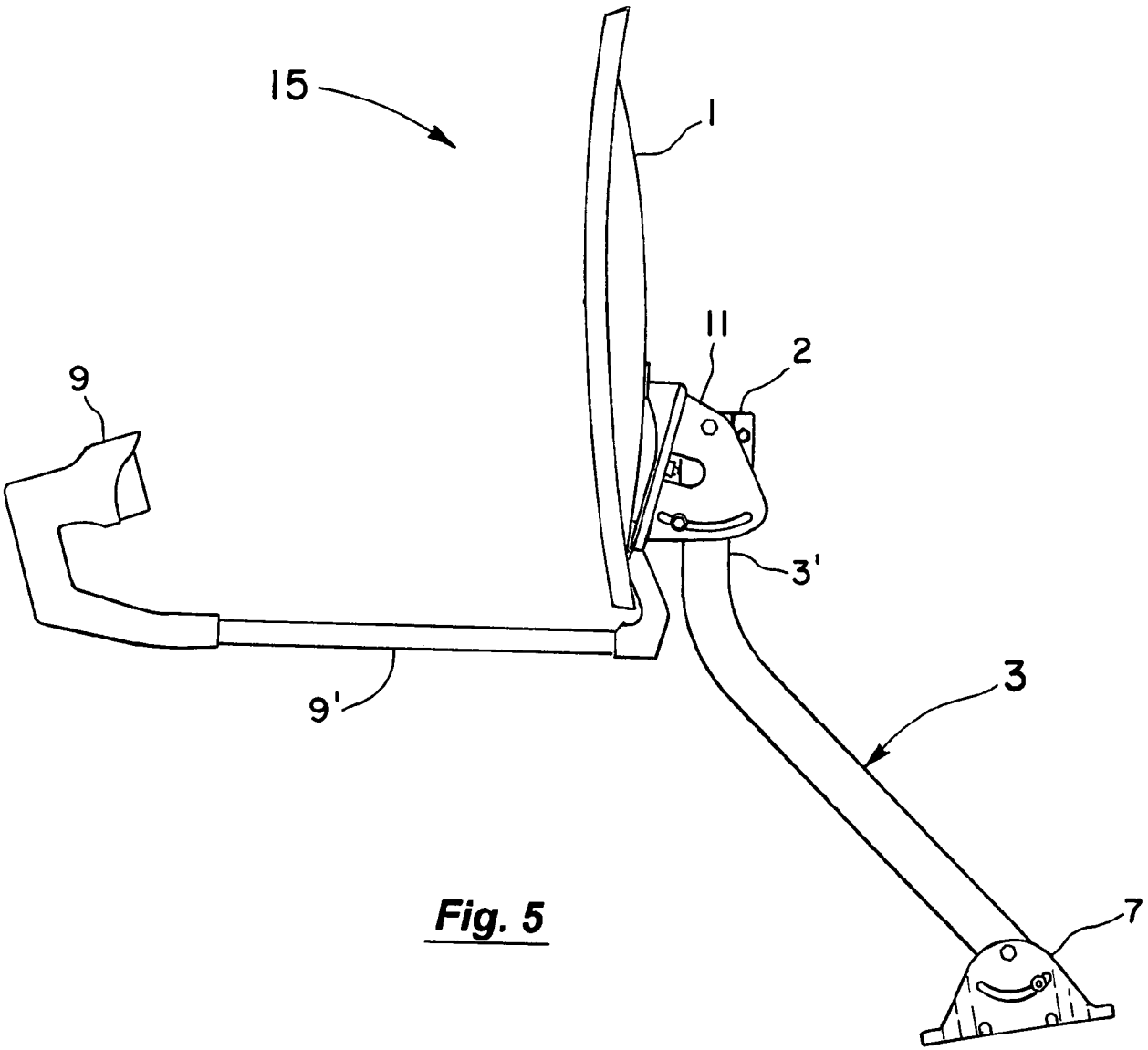
FIG. 5 is a side elevational view of the satellite dish antenna mounting system in its operating position.
Figure 6:
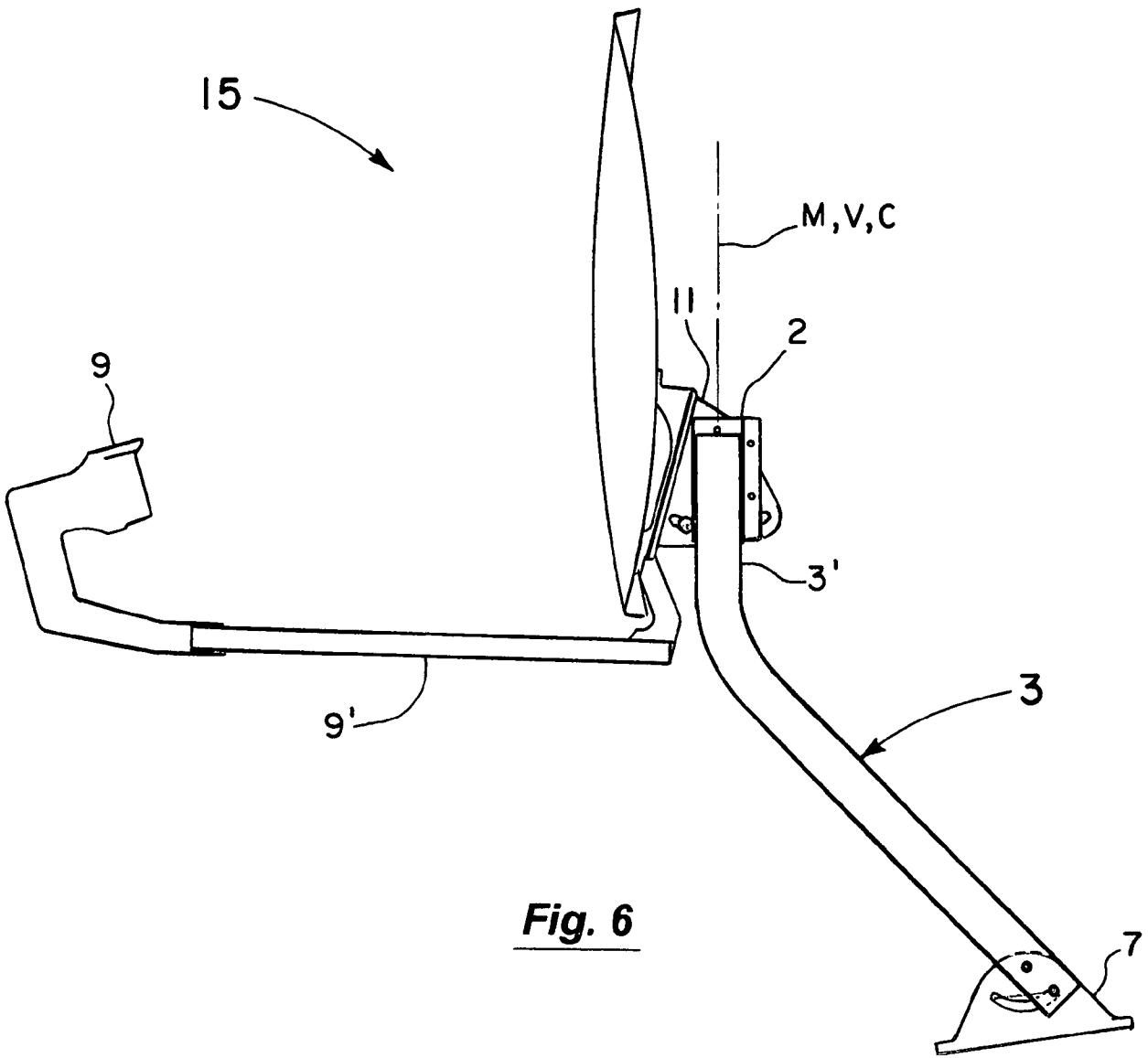
FIG. 6 is a view similar to FIG. 5 with sections of the mast and mast clamp cutaway.

In FIG. 1, the antenna dish 1 is shown mounted on the mast 3. The mast 3 in turn is secured to a fixed object such as the roof 5 of a house by the mounting foot 7. The illustrated arrangement of FIGS. 1 and 2 also includes the feed horn 9, its support arm 9', elevation bracket 11, and mast clamp 2. In assembling the basic elements of FIGS. 1 and 2, the antenna dish 1 (see FIG. 2) is attached to the elevation bracket 11 along with the support arm 9' and feed horn 9. With the elevation bracket 11 then secured to the mast clamp 2 (FIGS. 3-4), the assemblage 15 (FIG. 4) of the antenna dish 1, feed horn 9, support arm 9', elevation bracket 11, and mast clamp 2 can be manually manipulated as a unit and secured in place on the upper section 3' of the mast 3 (FIGS. 5-6).

Figure 7:
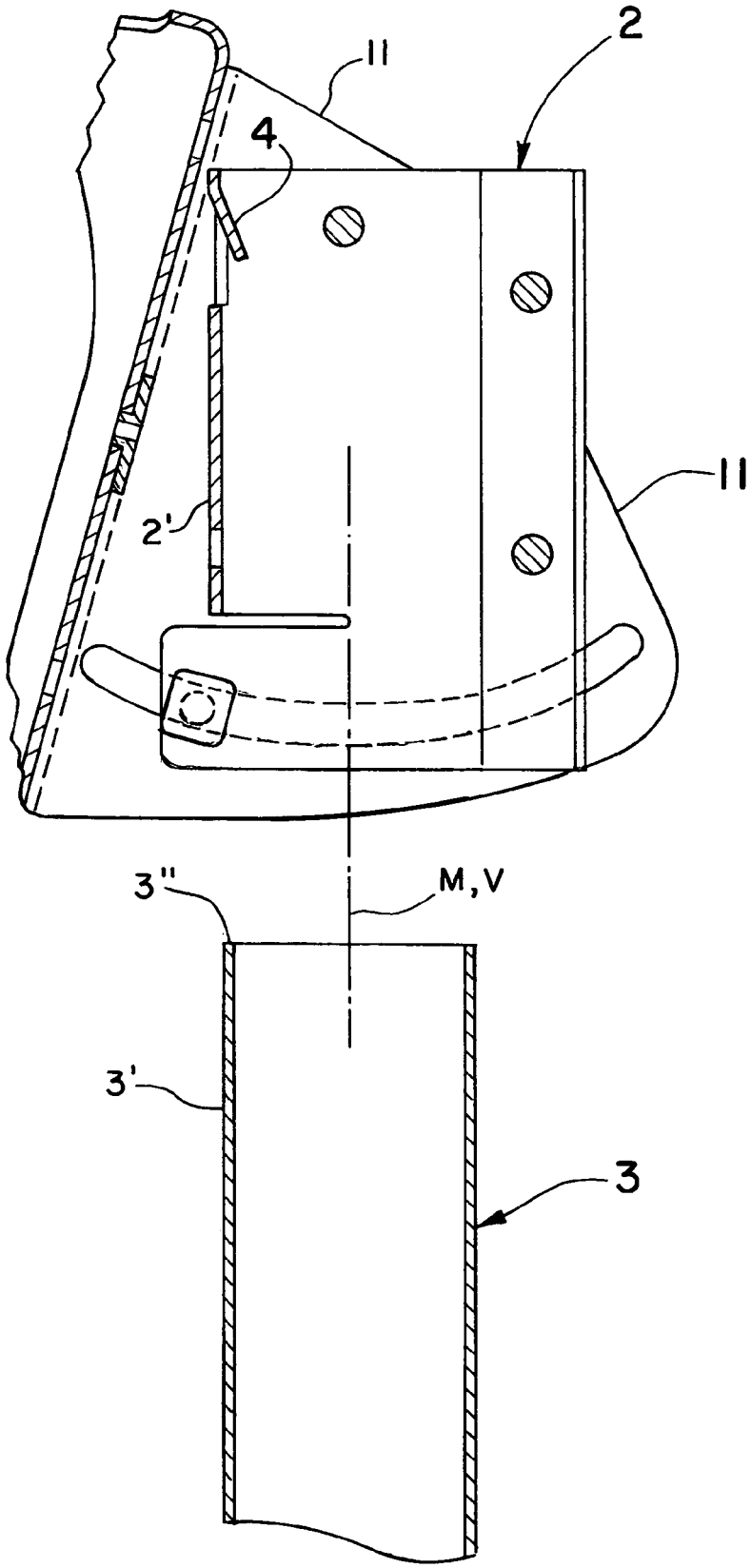
FIG. 7 is a cross-sectional view of the mast and mast clamp with the mast clamp in a position to be lowered onto the mast.
Figure 9:
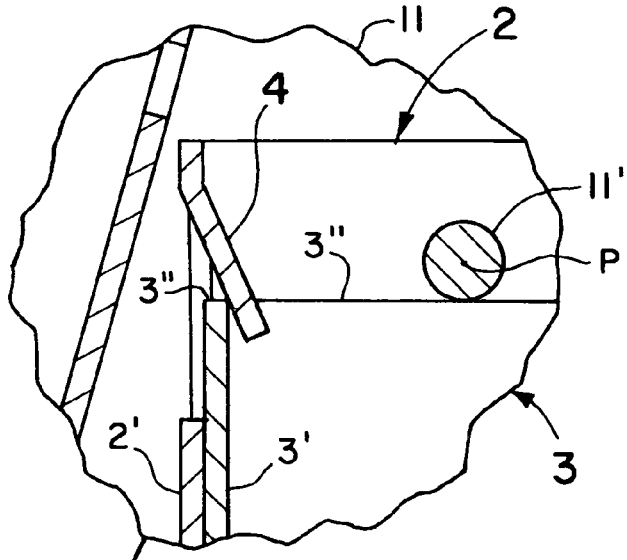
FIG. 9 is an enlarged view taken from FIG. 8 of the tab or clip member of the mast clamp that engages the upper rim of the mast.
Figure 8:
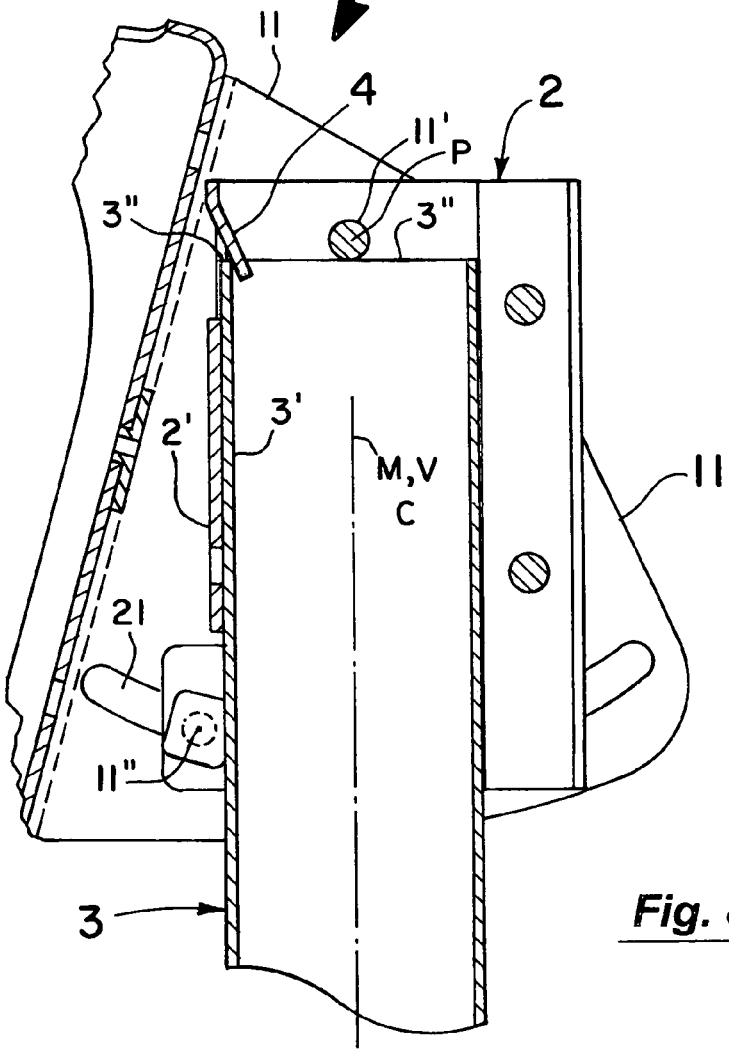
FIG. 8 illustrates the mast clamp in its lowered and tightened position on the mast.
Figure 10:
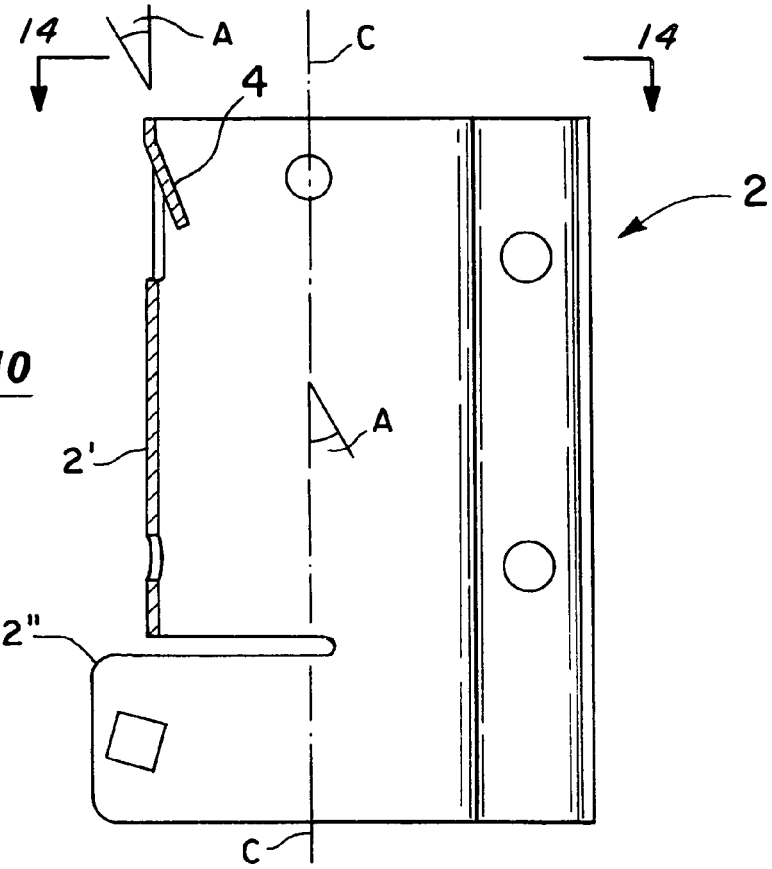
FIGS. 10-14 illustrate various views of the mast clamp of the present invention.
Figure 11:
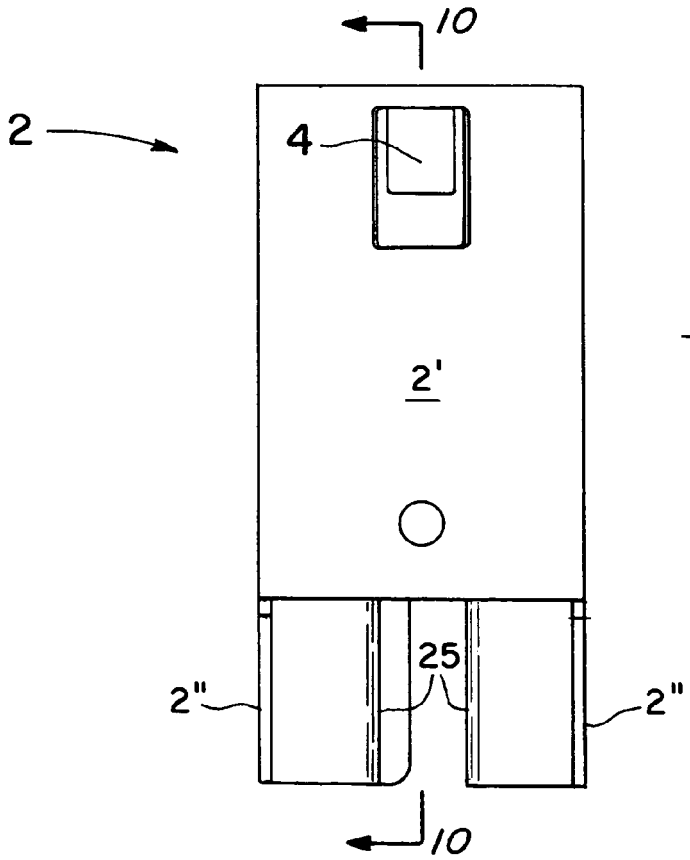
Figure 12:
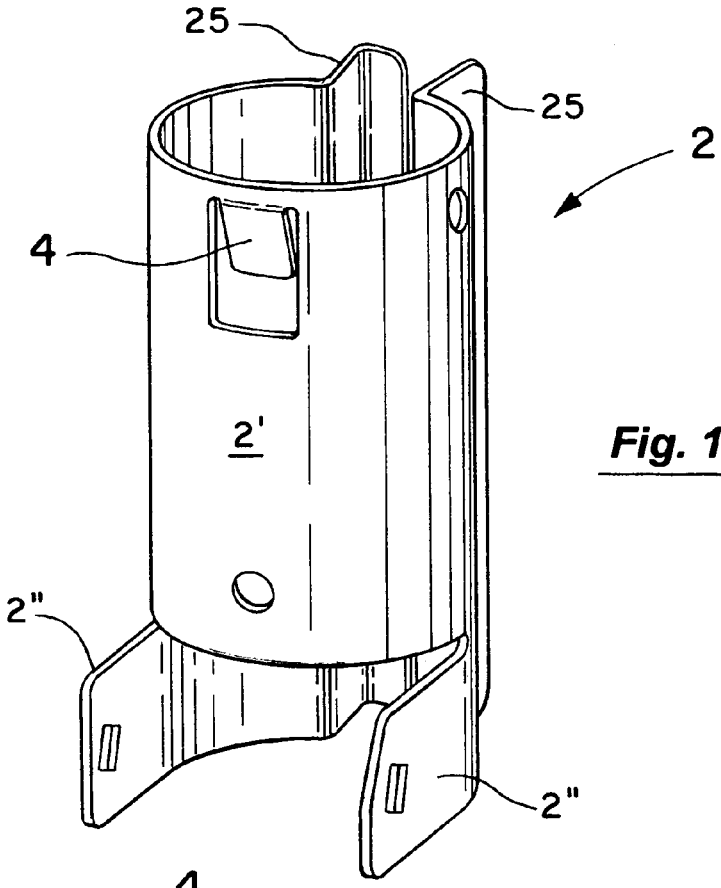
Figure 13:
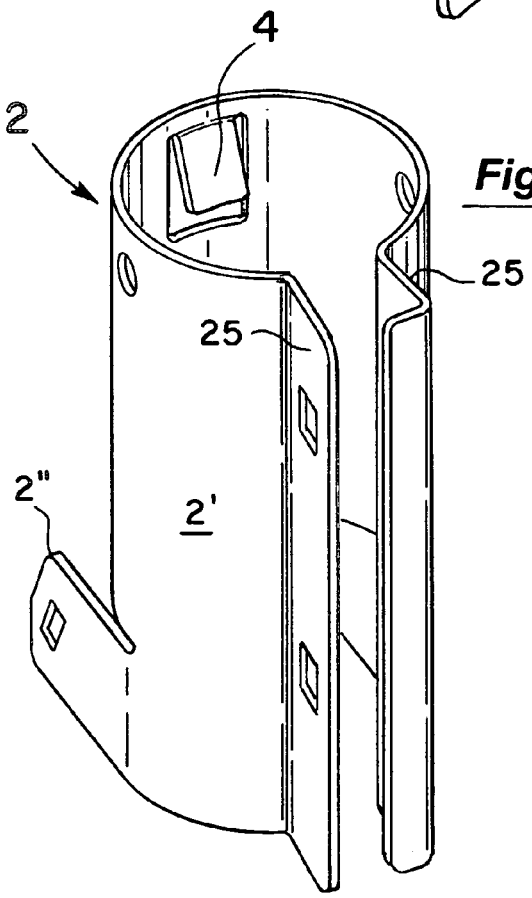
Figure 14:
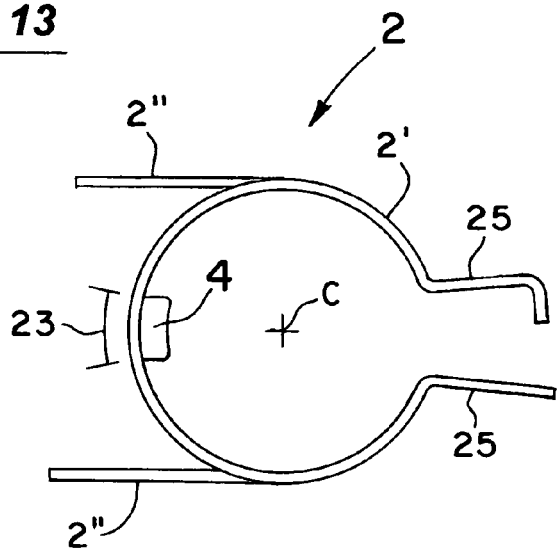

In doing so, the mast clamp 2 as best seen in FIGS. 7-9 has a tab or clip member 4 extending downwardly and inwardly from the main body 2' of the mast clamp 2. As the mast clamp 2 of FIG. 7 (with the attached elevation bracket 11, antenna dish 1, feed horn 9, and support arm 9') is lowered to receive the cylindrical upper section 3' of the mast 3, the downwardly and inwardly inclined tab or clip member 4 (FIGS. 8-9) engages the upper rim 3" of the mast 3. In the final operating position of FIGS. 1 and 8-9 with the mast clamp 2 fully tightened on the upper section 3' of the mast 3, the clamp axis C (FIG. 8) and mast axis M are preferably aligned in a collinear manner. Ideally, this collinear position is also aligned with the true vertical V. However, to the extent it is not, the clamp and mast axes C and M are still preferably aligned collinearly with each other.

Figure 3:
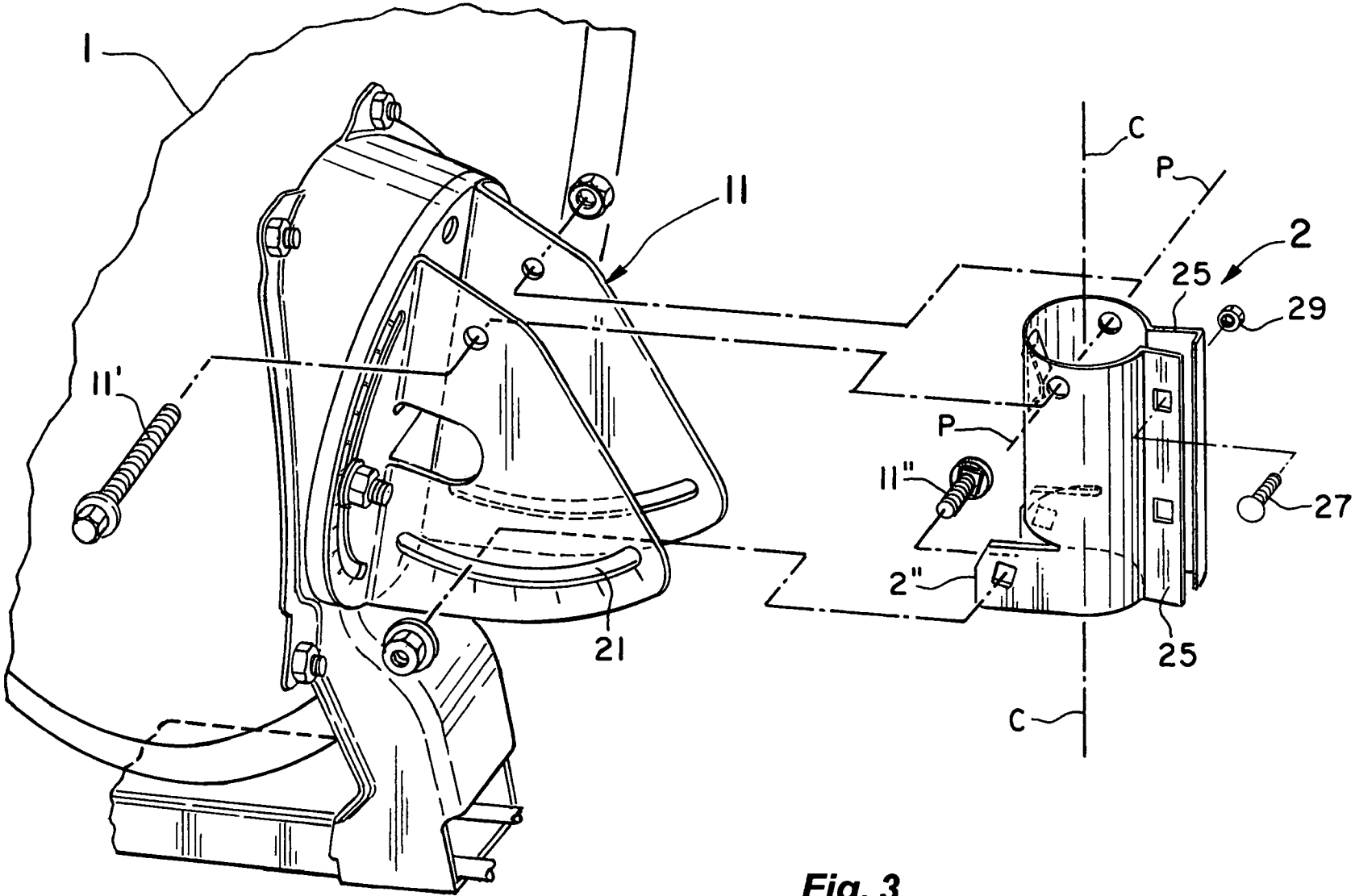
FIG. 3 is an enlarged view of the manner in which the elevation bracket is attached to the mast clamp.

In the final operating position of FIG. 8, the pivot bolt 11' of the elevation bracket 11 preferably rests on and abuts the upper rim 3" of the mast 3 as shown. The pivot bolt 11' in this regard in cooperation with a pair of bolts 11" (only one of which is shown for clarity in FIG. 3) adjustably mounts the elevation bracket 11 to the mast clamp 2. In this regard, each bolt 11" (FIG. 3) passes through a respective clamp ear 2" and arcuate slot 21 in the elevation bracket 11. In this manner as illustrated in FIG. 8 with the mast clamp 2 remaining tightly secured to the mast 3, each bolt 11" on each ear 2" (see also FIG. 3) can be loosened. The elevation bracket 11 can then be manually pivoted about the axis P of FIGS. 3 and 8 relative to the mast clamp 2. The pivotal axis P in this regard is preferably perpendicular to the clamp axis C (FIGS. 3 and 8). Consequently, with such pivotal adjustments of the elevation bracket 11 about the preferably horizontal axis P, the elevation of the antenna dish 1 attached to the elevation bracket 11 can be adjusted as desired.

Further details of the mast clamp 2 of the present invention and its tab or clip member 4 are shown in FIGS. 10-14. As perhaps best seen in FIGS. 10 and 14, the main body 2' of the mast clamp 2 (FIG. 10) has a substantially C-shape (FIG. 14) extending along and about the clamp axis C. The tab or clip member 4 preferably extends downwardly and inwardly from or relative to the main body 2' (FIG. 10) toward the clamp axis C at an acute angle A substantially between 10 and 50 degrees (e.g., 20 degrees). Additionally, the arcuate tab or clip member 4 (FIG. 14) preferably extends about the clamp axis C at 23 substantially between 5 and 45 degrees (e.g., 25 degrees). In use and in fixedly securing the C-shaped main body 2' of the mast clamp 2 on the upper section 3' of the mast 3, the wings 25 (FIGS. 14-15) of the clamping mechanism of the mast clamp 2 are drawn together (FIG. 16) by tightening bolt 27 within the nut 29. In the final operating position of FIG. 16, the clamp and mast axes C and M as indicated above are preferably collinear and aligned with the true vertical V.

Figure 4:
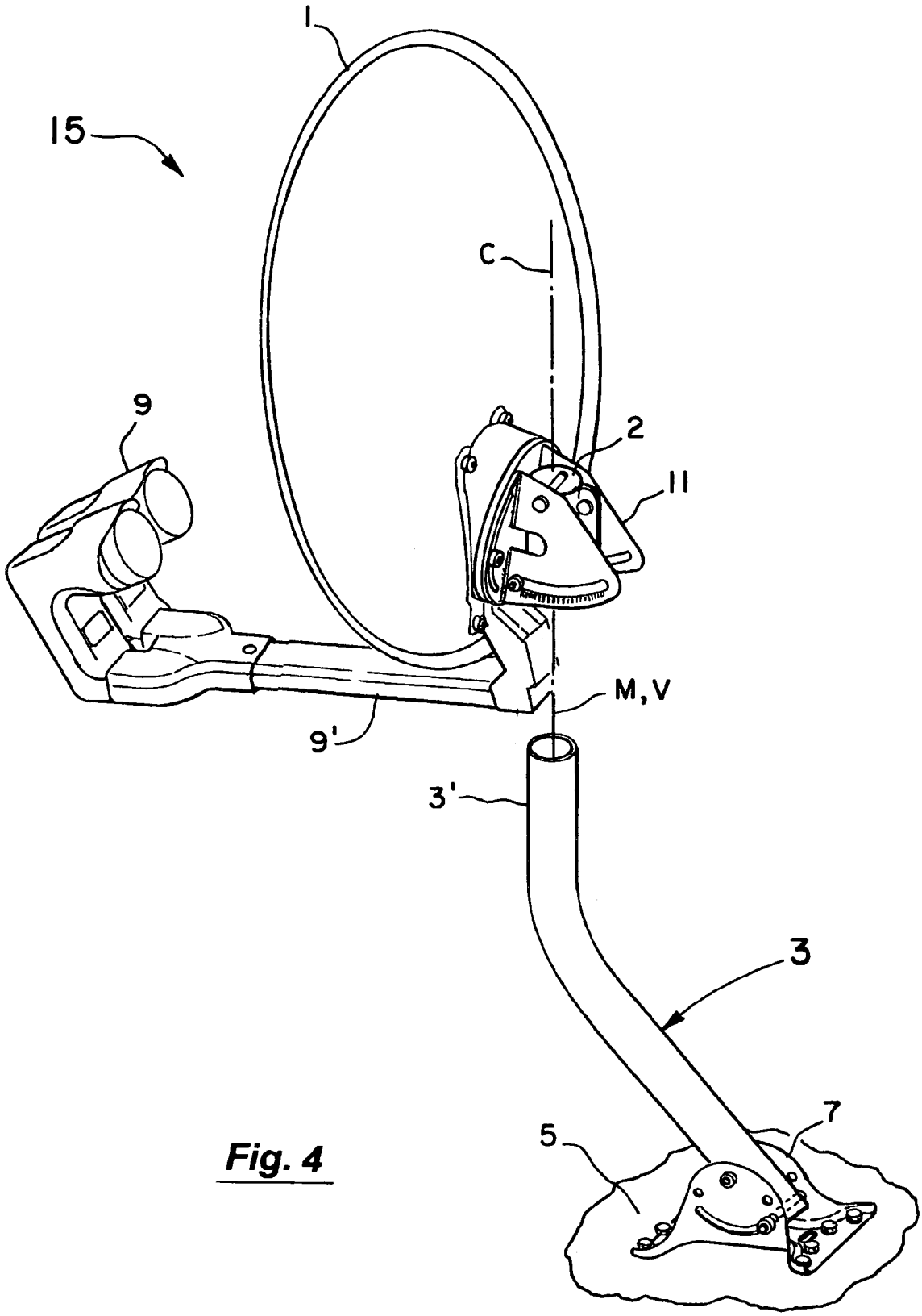
FIG. 4 is a view of the assemblage of the dish, feed horn, elevation bracket, and mast clamp in a position to be lowered as a unit onto the mast.
Figure 18:
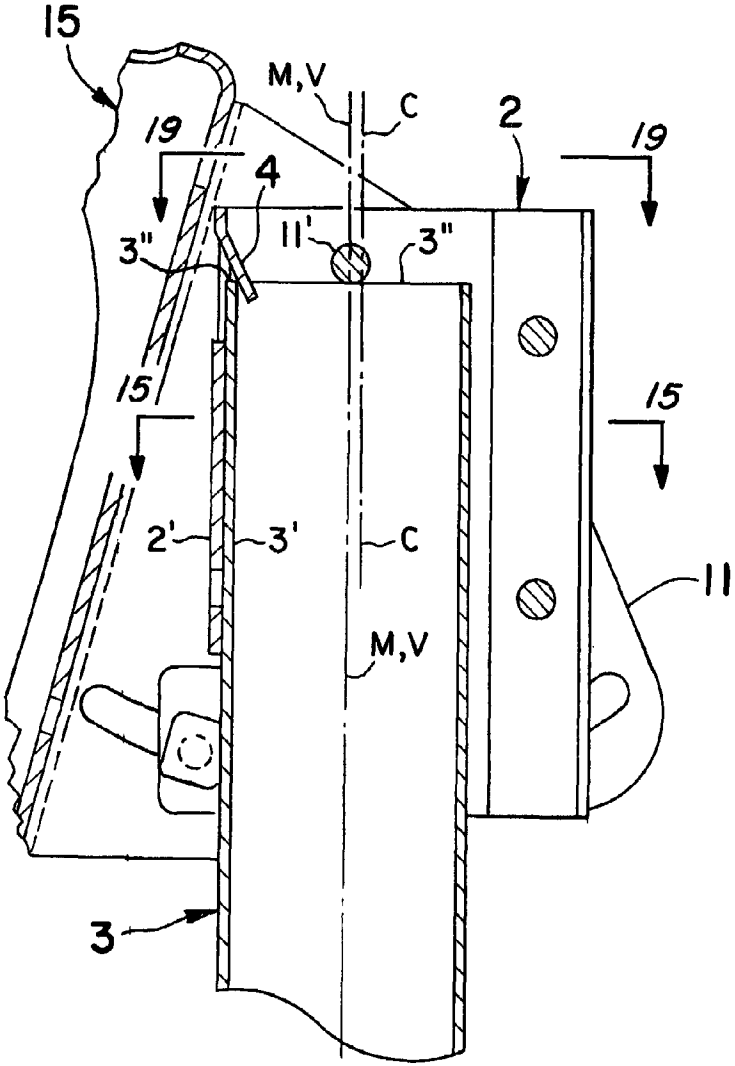
FIG. 18 is a view similar to FIG. 17 showing the mast clamp of the present invention being clipped in an aligned position on the mast while the mast clamp is still loose.
Figure 17:
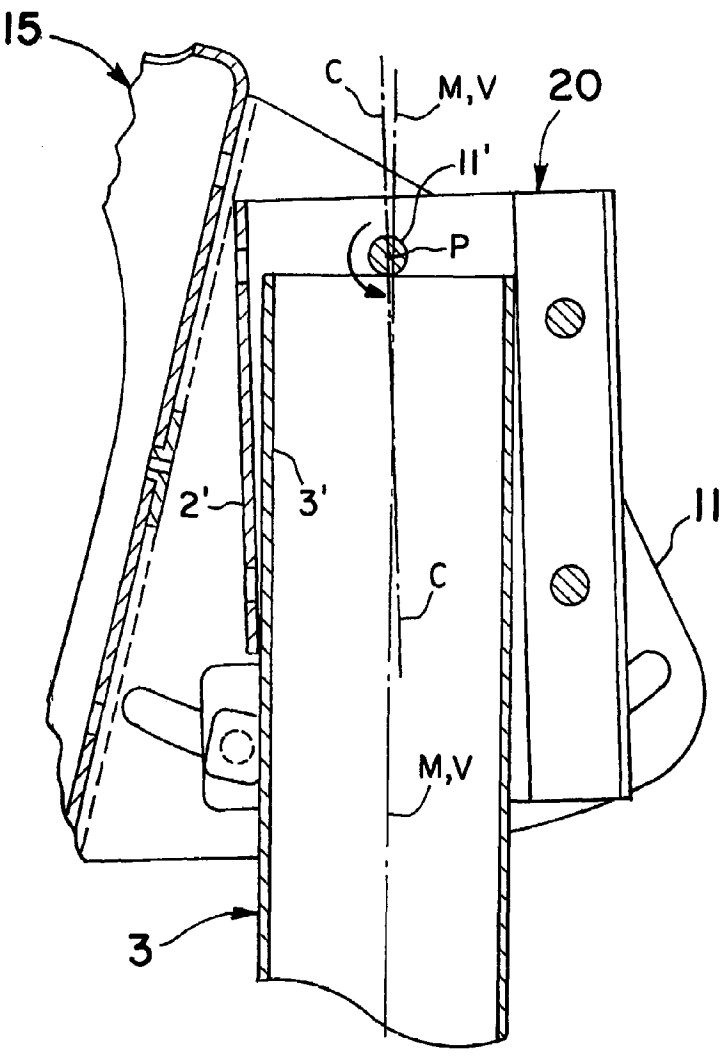
Fig. 17 (Prior Art)
FIG. 17 illustrates a prior art mast clamp without the tab or clip member of the present invention.

The advantage of having the downwardly and inwardly inclined tab or clip member 4 is perhaps best appreciated by first viewing FIGS. 4 and 6 and then comparing FIGS. 17 and 18. That is and as shown in FIGS. 4 and 6, nearly all of the weight of the assemblage 15 (including the antenna dish 1, feed horn 9, support arm 9', and elevation bracket 11) is unevenly offset on the mast clamp 2 to one side (i.e., the left side in FIGS. 4 and 6) of the clamp axis C. Consequently and without the tab or clip member 4 (see FIG. 17), the assemblage 15 of members 1, 9, 9', 11, and the prior art mast clamp 20 of FIG. 17 will rock or pivot about the axis P of the pivot bolt 11' of the elevation bracket 11. This rocking or pivoting will occur as shown in FIG. 17 when the mast clamp 2 of the assemblage 15 is first loosely fitted over the upper section 3' of the mast 3. It is then very difficult if not impossible to accurately pre-set the correct elevation of the antenna dish 1 and elevation bracket 11 on the mast clamp 2 so that the elevation will end up being correct when the mast clamp 2 is tightened. This is the case because the prior art mast clamp 20 of FIG. 17 (with the attached elevation bracket 11 and antenna dish 1) will be moved or rotated (i.e., clockwise in FIG. 17) about the pivotal axis P when the mast clamp 20 is tightened. In the tightened position, the previously crossing and unaligned clamp axis C of FIG. 17 will then become aligned with the mast axis M and the vertical V.

It is possible that the elevation bracket 11 and attached antenna dish 1 on the prior art mast clamp 20 of FIG. 17 may by chance end up on the mast 3 in the correct elevation and azimuth positions when the prior art mast clamp 20 is tightened. However, as a practical matter, this rarely happens and readjustments are necessary. As for example, if it turns out the elevation is incorrect but the azimuth is properly set, the elevation bracket 11 must be adjusted on the mast clamp 20. This can be done without loosening the mast clamp 20. On the other hand, if the azimuth is incorrect, the prior art mast clamp 20 must be loosened and the mast clamp 20 with the attached elevation bracket 11 and antenna dish 1 moved to a different azimuth position and the mast clamp 20 re-tightened. To the extent the re-adjusted azimuth position is still incorrect, the process must be repeated until the correct one in the tightened position is achieved. Unfortunately, with each loosening and re-tightening of the prior art mast clamp 20, the clamp axis C is first moved out of alignment with the axes M and V and then back toward alignment. As a practical matter and with each such azimuth adjustment, the elevation typically must also be re-adjusted. This procedure can obviously be a very time consuming and inefficient way to arrive at the correct elevation and azimuth settings of the antenna dish 1.

Figure 15:
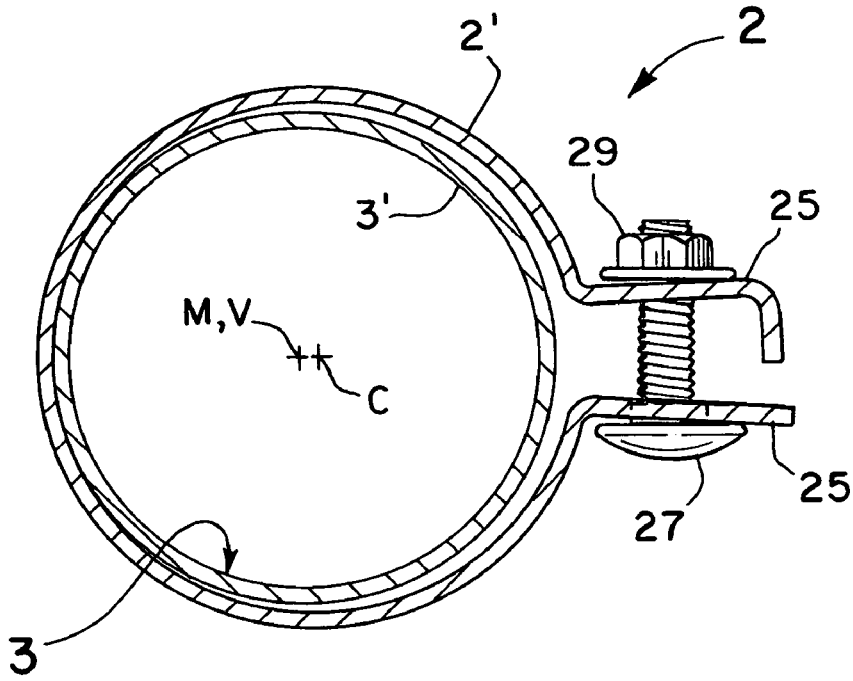
FIGS. 15-16 show the manner in which the mast clamp can be tightened on the mast.
Figure 16:
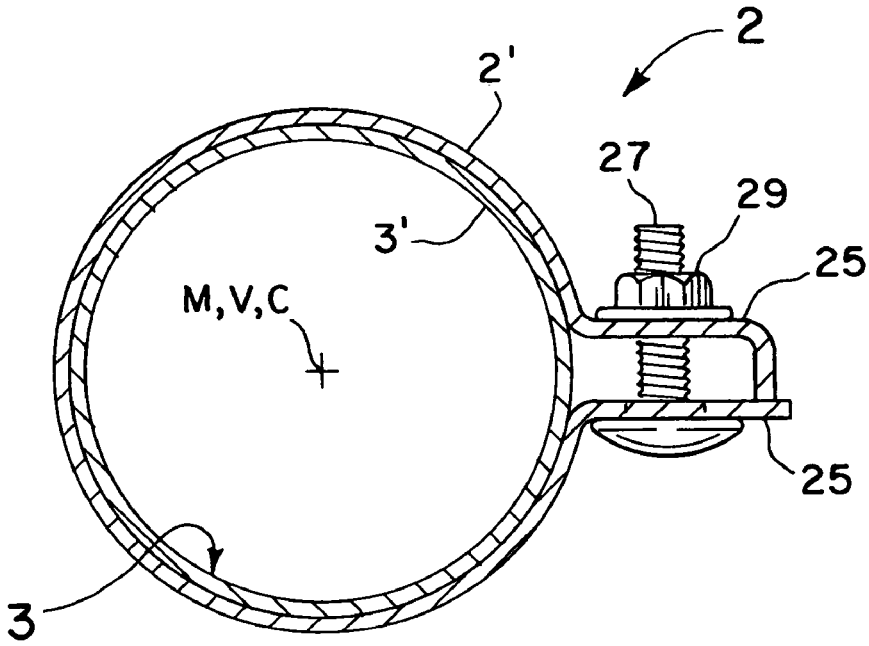

In contrast and with the tab or clip member 4 of the present invention as illustrated in FIG. 18, the mast clamp 2 in the loose or unclamped open position of FIGS. 15 and 18 will be secured or clipped (FIG. 18) on the upper rim 3" of the mast 3. In this clipped position of FIG. 18, the clamp axis C is aligned (e.g., parallel with and slightly laterally spaced from) the mast axis M (see also FIG. 15). Ideally, the mast axis M is aligned with the true vertical V (FIG. 15) and the clamp axis (although offset) is then also aligned with the vertical V. The clamping mechanism 25,27,29 (FIG. 15) of the mast clamp 2 at this point is still in its open position. However, even as the clamping mechanism 25,27,29 is tightened to its closed position (FIG. 16) to fixedly secure the mast clamp 2 on the mast 3, the alignment of the clamp axis C with the mast axis M and true vertical V does not change. This is the case even though the clamp axis C is preferably being laterally moved from its parallel position (FIG. 15) to being collinear or at least substantially collinear with the mast axis M and the true vertical V (FIG. 16).

Stated another way, the advantage of the tab or clip member 4 of the present invention is that the mast clamp 2

(with the attached elevation bracket 11 and antenna dish 1) can be attached or clipped on the mast 3 (FIG. 18) with the mast clamp 2 still loose. Further, in doing so, the clamp axis C will already be aligned (e.g., parallel) with the mast axis M and the antenna dish 1 elevation correctly set. The mast clamp 2 is thus separately supported on the mast 3 even with the clamping mechanism open. Thereafter, when the mast clamp 2 is tightened on the mast 3, the clamp and mast axes C and M will stay so aligned (e.g., parallel and preferably even collinear). More importantly, the elevation setting of the elevation bracket 11 on the mast clamp 2 will not change as the mast clamp 2 is tightened on the mast 3. Since the alignment of the mast clamp 2 is not affected by the tightening of the clamping mechanism 25,27,29 of FIGS. 15-16, the set elevation of the elevation bracket 11 also will not change. Setting the elevation is thus independent of and not affected by the tightening steps of FIGS. 15-16.

Figure 19:
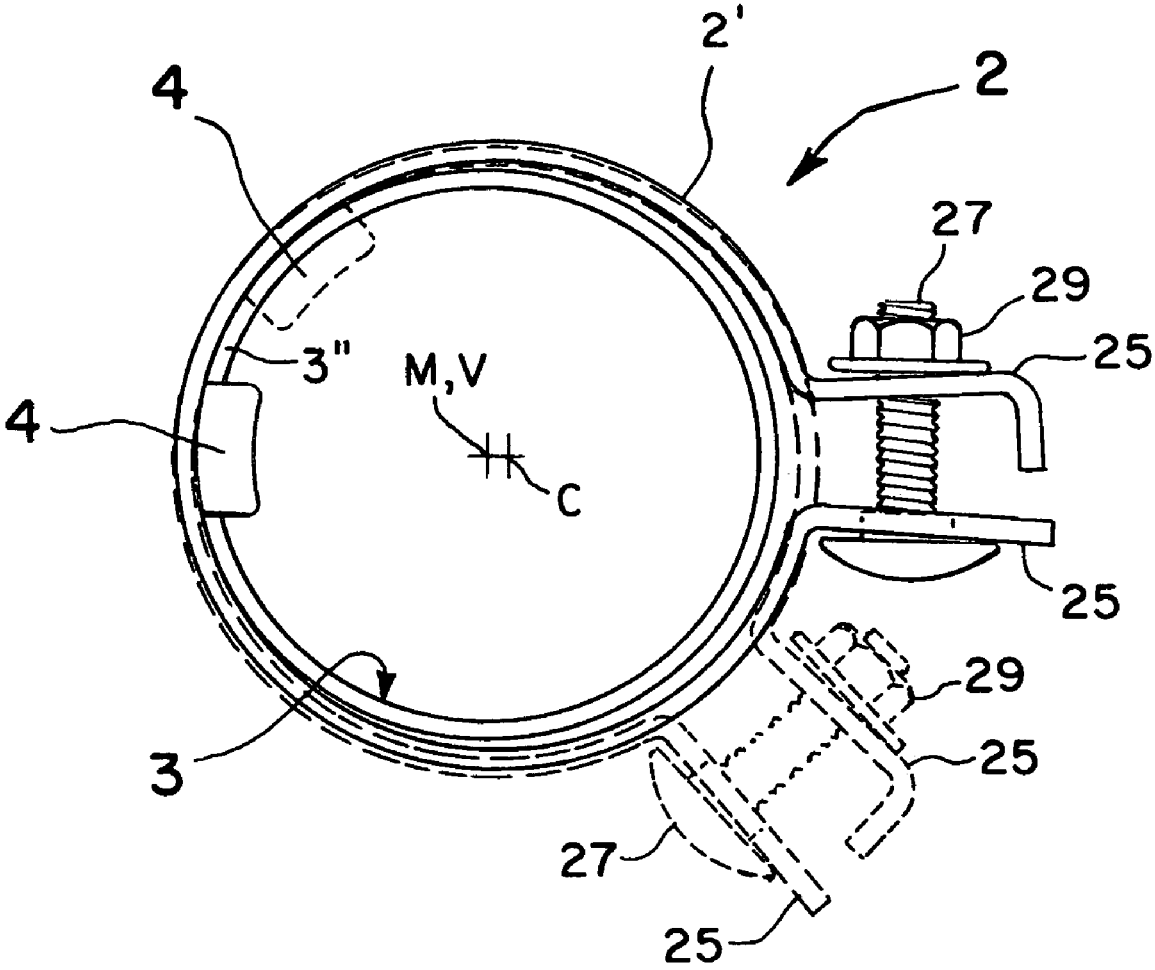
FIG. 19 is a view taken along line 19-19 of FIG. 18.
Figure 21:
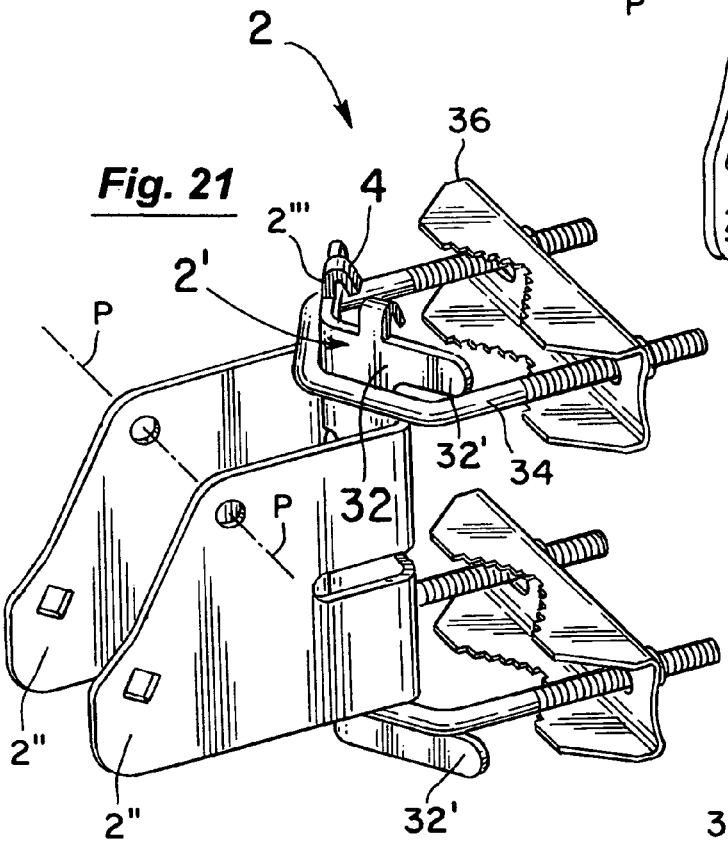
Figure 22:
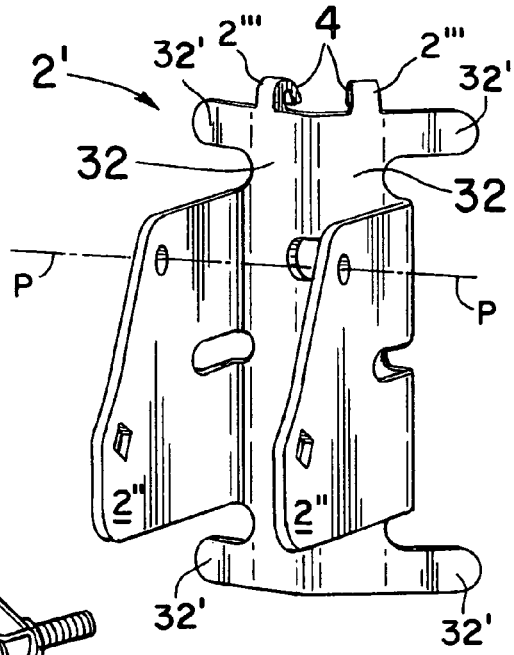
Figure 23:
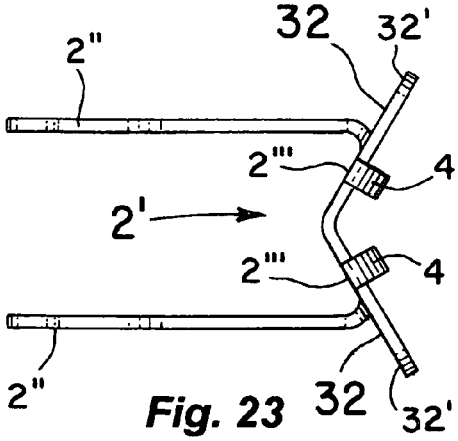
Figure 24:
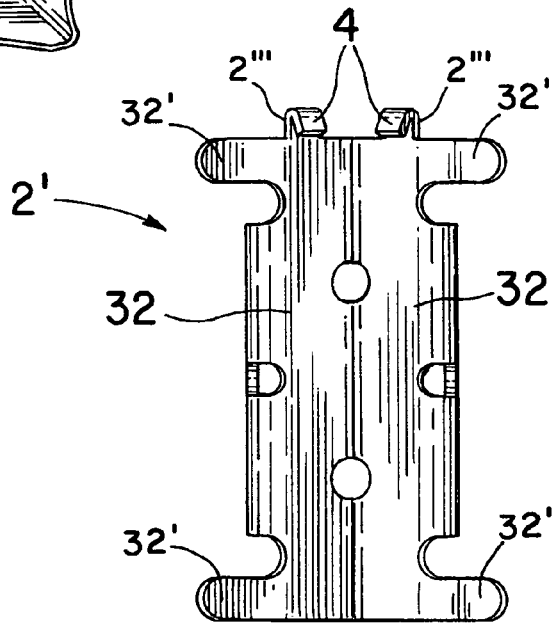

Preferably, the mast clamp 2 is initially clipped on the mast 3 at the correct azimuth about the vertical axis V. However, to the extent it is not, the mast clamp 2 in its unclamped open position (FIG. 19) can be manually rotated on the mast 3 about the mast axis M. Once the azimuth is correctly aligned, the mast clamp 2 can then be tightened in place without changing the elevation setting. That is and whether the mast clamp 2 is manually slid or rotated about the mast axis M with the member 4 remaining clipped in place (FIG. 19) or completely removed and re-clipped in place, the axes C and M will still be aligned. Also, to the extent the elevation bracket 11 and attached antenna dish 1 are not at the desired elevation setting when the mast clamp 2 is initially clipped on the mast 3, the elevation bracket 11 and attached antenna dish 1 can be adjusted about the horizontal pivot axis P. This adjustment to the elevation setting can be done if desired with the mast clamp 2 still clipped in place on the mast 3 in the unclamped position of FIGS. 15 and 18 or in its clamped position of FIG. 16.

It is noted that the tab or clip member 4 of the present invention is preferably used with an elevation bracket of the type illustrated which has a pivot bolt 11'. In addition to its function to allow the elevation bracket 11 to be pivotally adjusted on the mast clamp 2, the bolt 11' also serves a stop with the clip member 4 by abutting the upper rim 3" of the mast 3 (FIG. 18). However, the clip member 4 of the present invention can be used with other elevation brackets that do not have an elongated pivot bolt such as 11 extending across the C-shaped main body 2' of the mast clamp 2. The tab or clip member 4 can then serve alone as the stop. Further, in this regard and as discussed above, the tab or clip member 4 is arcuate at 23 about the clamp axis C (see again FIG. 14). This helps to create strength in the clip member 4 as well as a tight grip or wedge along the arcuate upper rim 3" of the mast 3 which the clip member 4 engages. These features aid in countering any torque force created by the offset weight distribution of the assemblage 15 as discussed above.

Also, it is noted that the portion of the main body 2' extending along the clamp axis C immediately below the clip member 4 (FIG. 18) preferably abuts against the cylindrical upper section 3' of the mast 3. This occurs both when the mast clamp is in an open position (FIG. 15) and in its closed position (FIG. 16). This abutting portion among other things also aids in countering any torque force from the offset weight of the assemblage 15. The portions of the main body 2' immediately to the sides of the clip member 4 about the clamp axis C also aid in this regard. This is the case even though other portions of the main body 2' (see FIG. 15) spaced farther about the clamp axis C from the clip member 4 are slightly spaced from the mast 3 when the mast clamp is loose. These spaced other portions, however, are preferably drawn in to also abut the mast 3 (FIG. 16) when the mast clamp 2 is tightened.

FIGS. 20-25 illustrate an embodiment in which the substantially C-shaped main body 2' of the mast clamp 2 has relatively flat sides 32 (perhaps best seen in FIGS. 23-24) forming the C-shape. Unlike the C-shape of FIG. 16 in which the curved inner surface of the main body 2' abuts or engages the outer surface of the upper mast portion 3' substantially entirely about the clamp axis C, the flat sides 32 of the embodiment of FIG. 20-25 essentially have point or line contacts with the upper mast portion 3' (FIG. 25). Although there can be a clip member 4 on each side 32 as shown, a single clip member 4 on only one side 32 would be sufficient. In operation, the clip member or members 4 engage the upper rim 3" of the mast 3 (FIGS. 20 and 25) and attach or clip the mast clamp 2 on the mast 3 with the clamping mechanism 34 and 36 in its open position (shown in dotted lines in FIG. 25). In the closed position of the clamping mechanism as shown in solid lines in FIG. 25, the member 36 is drawn in to abut the mast portion 3' and the member 34 embraces the sides 32 of the main body 2' adjacent the protruding arms 32' thereof (see also FIG. 21).

In the illustrated embodiment of FIGS. 20-25, the clip members 4 like the earlier embodiments extend downwardly and inwardly from or relative to the main body 2' of the mast clamp 2. The main body 2' in this regard has slight extensions at 2''' (perhaps best seen in FIGS. 22-24) from which the clip members 4 extend downwardly and inwardly. The clip members 4 of FIGS. 20-25 are also shown as extending laterally relatively straight or parallel to the flat sides 32 (FIG. 25) and pinching or wedging on the upper rim 3" of the mast 3 more or less at a point contact. However, the clip members 4 could be arcuate about the axis M of the mast 3 as in the earlier embodiments if desired to pinch or wedge on the upper rim 3" of the mast 3 along a curve or arc.

Figure 26:
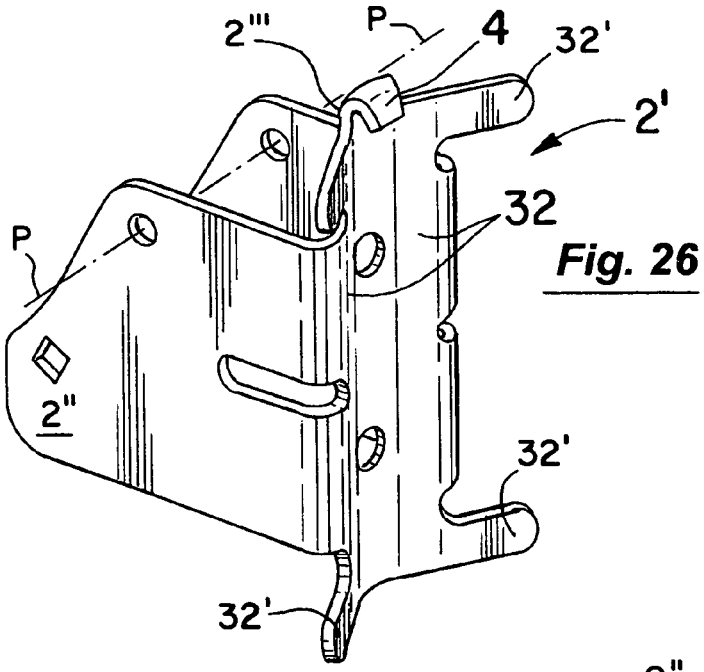
FIG. 26-28 illustrate further embodiments in which a clip member is positioned adjacent the junction of the flat sides forming the C-shape of the main body of the mast clamp.
Figure 27:
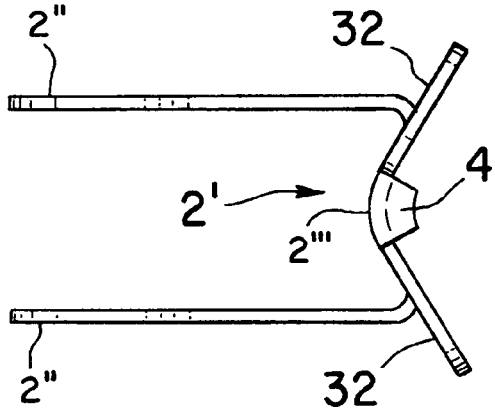
Figure 28:
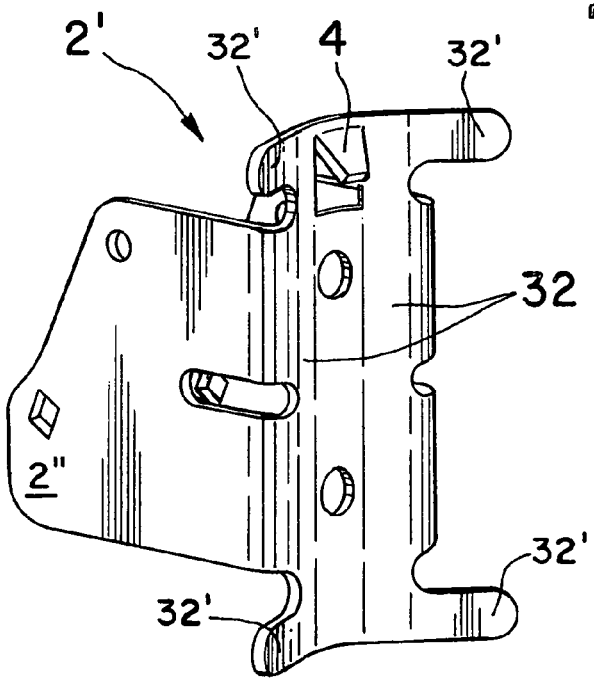

Additional embodiments are shown in FIGS. 26-28 in which the clip member 4 is shown at the junction of the flat sides 32 (FIG. 27) forming the C-shape. The member 4 is also illustrated as being arcuate about the main body 2' as in earlier embodiments. It is noted that the embodiment of FIGS. 26-27 like the one of FIGS. 20-25 has the clip member 4 extending downwardly and inwardly from a slight extension 2''' of the main body 2' whereas the clip member 4 of FIG. 28 is more like the other earlier embodiments.

Additional variations of clamp cross sections to make the substantially C-shape could also be used if desired. In such cases and without the clip member(s) 4 of the present invention, the closed and open positions of the clamping mechanism of the various C-shapes would create the problem illustrated in FIG. 17. This would occur whether the pivotal axis P of the elevation bracket 11 extends across the mast 3 as in FIG. 17 or is offset from it as in FIG. 20 or if other structure such as stops aid in creating the problem.

The above disclosure sets forth a number of embodiments of the present invention described in detail with respect to the accompanying drawings. Those skilled in this art will appreciate that various changes, modifications, other structural arrangements, and other embodiments could be practiced under the teachings of the present invention without departing from the scope of this invention as set forth in the following claims.

I claim:

1. An apparatus for mounting an antenna dish to a mast with a mast clamp, said apparatus including:

an antenna dish, mast clamp, and mast, said mast having a substantially cylindrical section supported to extend substantially along and about a substantially vertical first axis, said cylindrical section having an upper rim extending substantially about said first axis, an elevation bracket attachable to said antenna dish and said mast clamp, said mast clamp having a substantially C-shaped main body extending substantially along and about a second axis, said cylindrical section of said mast being at least partially receivable in the C-shaped main body of said mast clamp, said mast clamp having a clamping mechanism selectively operable between open and closed positions, said clamping mechanism in said closed position securing the C-shaped main body of the mast clamp to and at least partially about the cylindrical section of the mast in a fixed position relative to said mast, said mast clamp with the clamping mechanism in the open position being manually movable about said first axis relative to the cylindrical section of the mast, said mast clamp further including at least one downwardly extending clip member, said clip member being engagable with the upper rim of the cylindrical section of the mast to separately support said mast clamp on said cylindrical section of the mast with said clamping mechanism in said open position, said mast clamp with said clamping mechanism in the open position being supported by said clip member on said mast with the second axis of the mast clamp substantially vertical and aligned with the first axis of the mast.

2. The apparatus of claim 1 wherein said clip member extends downwardly from the main body of the mast clamp.

3. The apparatus of claim 1 wherein said clip member extends inwardly of the main body of the clamp member toward said second axis.

4. The apparatus of claim 1 wherein said clip member extends downwardly at an acute angle substantially between 10 and 50 degrees.

5. The apparatus of claim 4 wherein said acute angle is about 20 degrees.

6. The apparatus of claim 1 wherein said clip member has a substantially arcuate shape about the second axis.

7. The apparatus of claim 6 wherein said clip member extends substantially between 5 and 45 degrees about the second axis.

8. The apparatus of claim 7 wherein said clip member extends about 25 degrees about the second axis.

9. The apparatus of claim 1 wherein a first portion of the C-shaped main body of the mast clamp extends along said second axis and abuts the cylindrical section of the mast with the clamping mechanism in the open position and a second portion of the C-shaped main body positioned about the second axis from the first portion extends along said second axis and is spaced from the cylindrical section of the mast with the clamping mechanism in said open position.

10. The apparatus of claim 9 wherein said second portion of said C-shaped main body of the mast clamp abuts said cylindrical section of the mast with said clamping mechanism in said closed position.

11. The apparatus of claim 1 wherein said elevation bracket is adjustably securable to said mast clamp for movement relative thereto about a third axis substantially perpendicular to said second axis.

12. The apparatus of claim 11 wherein said elevation bracket includes an elongated member secured thereto and extending across the C-shaped main body of the mast clamp to abut the upper rim of said cylindrical section of said mast with said clamping mechanism in said open position.

13. The apparatus of claim 12 wherein said elongated member abuts the upper rim of said cylindrical section of said mast with said clamping mechanism in said closed position.

14. The apparatus of claim 1 wherein said second axis of said mast clamp is secured in an aligned position relative to a true vertical position in said fixed position on said mast with said clamping mechanism in said closed position and said clip member supports said mast clamp in said aligned position relative to said true vertical position when said clamping mechanism is in said open position.

15. The apparatus of claim 1 wherein the C-shape of the substantially C-shaped main body is formed by a curved surface.

16. The apparatus of claim 1 wherein the C-shape of the substantially C-shaped main body is formed by at least two, substantially flat sides.

17. A method for mounting an antenna dish to a mast, said method including the steps of:

(a) providing an antenna dish, elevation bracket, mast, and mast clamp, said mast having a substantially cylindrical section supported to extend substantially along and about a first axis, and said mast clamp having a substantially C-shaped main body extending substantially along and about a second axis, said mast clamp having a clamping mechanism movable between an open position to loosely receive the cylindrical section of the mast therein and a closed position to secure said mast clamp to said cylindrical section of the mast in a fixed position relative thereto, (b) securing the antenna dish, elevation bracket, and mast clamp together, (c) attaching said mast clamp to said mast with the second axis of said mast clamp aligned with the first axis of the mast and with said clamping mechanism in said open position, and (d) moving said clamping mechanism to said closed position to secure said mast clamp to said mast in said fixed position while maintaining the second axis of said mast clamp in alignment with the first axis of the mast.

18. The method of claim 17 wherein the attaching step (c) includes the further limitation clipping the main body of the mast clamp to the cylindrical section of said mast.

19. The method of claim 18 wherein step (c) includes the further limitation of clipping the main body of said mast clamp to said cylindrical section of said mast with at least one downwardly extending member.

20. The method of claim 17 including the further limitation of adjustably securing said elevation bracket and antenna dish to the mast clamp for movement relative to said mast clamp about a third axis substantially perpendicular to the second axis of the mast clamp.

21. The method of claim 17 further including the step of (e) moving said clamping mechanism to said open position while maintaining the second axis of said mast clamp aligned with the first axis of the mast.

22. The method of claim 21 including the further step of (f) moving said mast clamp about said second axis relative to said mast with said clamping mechanism in said open position.

23. The method of claim 22 including the further limitation of repeating step (d) after step (f).

* * * * *